US008967774B2

(12) United States Patent
Horiguchi et al.

(10) Patent No.: US 8,967,774 B2
(45) Date of Patent: Mar. 3, 2015

(54) LIQUID JET HEAD, LIQUID JET APPARATUS, AND METHOD OF MANUFACTURING LIQUID JET HEAD

(71) Applicant: SII Printek Inc., Chiba (JP)

(72) Inventors: Satoshi Horiguchi, Chiba (JP); Yuki Yamamura, Chiba (JP); Yuzuru Kubota, Chiba (JP); Yoshinori Domae, Chiba (JP); Makoto Suzuki, Chiba (JP); Ryoichiro Yamashita, Chiba (JP); Masatoshi Toda, Chiba (JP); Toshihiko Harajiri, Chiba (JP); Shinji Saeki, Chiba (JP)

(73) Assignee: SII Printek Inc. (JP)

( * ) Notice: Subject to any disclaimer, the term of this patent is extended or adjusted under 35 U.S.C. 154(b) by 0 days.

(21) Appl. No.: 14/075,008

(22) Filed: Nov. 8, 2013

(65) Prior Publication Data

US 2014/0139592 A1 May 22, 2014

(30) Foreign Application Priority Data

Nov. 19, 2012 (JP) ..... 2012-253550

(51) Int. Cl.
*B41J 2/045* (2006.01)
*B41J 2/16* (2006.01)

(52) U.S. Cl.
CPC ..... *B41J 2/1623* (2013.01); *B41J 2/1609* (2013.01); *B41J 2/1626* (2013.01); *B41J 2/1631* (2013.01); *B41J 2/1632* (2013.01)
USPC ..... 347/68

(58) Field of Classification Search
CPC .... B41J 2/14209; B41J 2/1609; B41J 2/1623; B41J 2/14201; B41J 2/1621
USPC ..... 347/68–72; 29/890.1
See application file for complete search history.

(56) References Cited

U.S. PATENT DOCUMENTS 8,651,631 B2 * 2/2014 Koseki ..... 347/71

FOREIGN PATENT DOCUMENTS

| | | |
|---|---|---|
| EP | 0943440 | 9/1999 |
| EP | 2130678 | 12/2009 |
| EP | 2322347 | 5/2011 |
| EP | 2452820 | 5/2012 |
| JP | 2002 529289 | 9/2002 |
| JP | 2003 094654 | 4/2003 |

OTHER PUBLICATIONS

IPO Search Report mailed May 15, 2014 issued in British Patent Appln. No. GB1320207.2.

* cited by examiner

*Primary Examiner* — An Do
(74) *Attorney, Agent, or Firm* — Adams & Wilks

(57) ABSTRACT

A liquid jet head includes an actuator substrate having ejection grooves and non-ejection grooves partitioned by walls each including a piezoelectric body. The non-ejection grooves have, at ends on one side thereof, respective inclined surfaces rising from bottom surfaces thereof to upper surface openings at upper portions thereof. Common electrodes are provided in a strip form along a longitudinal direction of the walls on both side surfaces of the walls facing the ejection grooves, and active electrodes are provided in a strip form along the longitudinal direction of the walls on both side surfaces of the walls facing the non-ejection grooves. The active electrodes extend from positions in the vicinity of the ends on one side of the non-ejection grooves to ends on the other side thereof.

18 Claims, 10 Drawing Sheets

LIQUID JET HEAD, LIQUID JET APPARATUS, AND METHOD OF MANUFACTURING LIQUID JET HEAD

BACKGROUND

1. Technical Field

The present invention relates to a liquid jet head that ejects liquid droplets to perform recording on recording media, a liquid jet apparatus using the liquid jet head, and a method of manufacturing the liquid jet head.

2. Related Art

In recent years, ink jet type liquid jet heads have been used that eject ink droplets onto recording papers or the like to record characters and graphics or eject liquid materials onto the front surfaces of element substrates to form functional thin films. According to the liquid jet heads of this type, liquid such as ink and liquid materials is introduced into channels from liquid tanks via supply tubes, and pressure is applied to the liquid filled in the channels to eject the liquid from nozzles communicating with the channels. In ejecting the liquid, the liquid jet heads or recording media are moved to record characters and graphics or form functional thin films having prescribed shapes.

FIGS. 15 and 16 are a cross-sectional view and a partial perspective view, respectively, of a small droplet deposition apparatus described in JP 2002-529289 W (FIGS. 5 and 7 of JP 2002-529289 W). As shown in FIG. 15, a cover member 130 is laminated on a front surface 120 of a substrate 86 in the small droplet deposition apparatus. The substrate 86 has integrated circuits 84 mounted at both ends thereof and a channel 82 composed of a groove at the central portion thereof. In addition, a layer 100 including two strips 110*a* and 110*b* made of a piezoelectric substance is provided on walls partitioning the channel 82 in a direction perpendicular to the sheet of the drawing, and nozzles 96*a* and 96*b* for ejecting small droplets are formed in two rows at the bottom of the channel 82 in the direction perpendicular to the sheet of the drawing. The cover member 130 has manifolds 88, 90, and 92 and conduits 150*a*, 150*b*, and 150*c* communicating with the respective manifolds 88, 90, and 92 and causing liquid to pass through. Operation portions 140*a* and 140*b* are provided on the two strips 110*a* and 110*b*, respectively, to close corresponding channels from the above.

The ink supplied to the manifold 90 flows into the channel 82 and flows to both ends of the channel 82 to be discharged from the manifolds 88 and 92. The ink supplied from the manifold 90 flows into the other channels in the direction perpendicular to the sheet of the drawing via the conduit 150*b* and flows out from the other channels to the manifolds 88 and 92 via the conduits 150*a* and 150*c* to be discharged. The strip 110*a* is driven to generate a pressure pulse in the ink below the strip 110*a* to eject small droplets from the nozzle 96*a*. Similarly, the strip 110*b* is driven to generate a pressure pulse in the ink below the strip 110*b* to eject small droplets from the nozzle 96*b*.

FIG. 16 is an enlarged view of the portions of the piezoelectric substance 110*a* and the channel 82. The substrate 86 has the channel 82 composed of a groove and a side wall 113 between the channel 82 and a channel on the back side. In addition, the strip 110*a* is provided on the top of the side wall 113. An electrode 190' is formed on the side wall 113 and the side surface of the strip 110*a* constituting the channel 82. Moreover, conductive tracks 192' and 192" electrically separated from each other are formed on a top front surface 113', an obliquely cut portion 195, the upper portion of the side wall 113, and a front surface 120 of the substrate 86. Thus, a drive signal may be applied to the electrode 190' on the front side of the side wall 113 and an electrode 190" on the back side.

SUMMARY

As shown in FIG. 16, in the small droplet deposition apparatus of JP 2002-529289 W, it is necessary to pattern and divide the electrode material of the top front surface 113' and the obliquely cut portion 195 of the strip 110*a* protruding from the front surface 120 of the substrate 86. In JP 2002-529289 W, it is described that the electrode material may be divided by laser beams. In addition, it is described that the electrode material may be more easily divided by a physical mask or electric discharge equipment. However, in a case where the electrode material is divided by the laser beams, it is necessary to scan the top front surface 113', the front surface of the obliquely cut portion 195, and the front surface 120 of the side wall 113 with the laser beams to pattern the electrode for each of a number of the side walls 113 and the strips 110*a* formed in parallel, which requires a long time and results in very low productivity. In addition, the thickness of the side wall 113 and the width of the top front surface 113' are as narrow as 40 μm to 100 μm, and a step exists between the top front surface 113' of the strip 110*a* and the front surface 120 of the substrate 86. Therefore, it is difficult to pattern the electrode material in a lump using a photosensitive resin. Moreover, the provision itself of the mask on the top front surface 113', the front surface of the obliquely cut portion 195, and the front surface 120 of the substrate 86 is very difficult.

The present invention has been made in view of the above problems, and an object of the invention is to provide a liquid jet head allowing electrodes to be easily formed on the side and upper surfaces of side walls, a liquid jet apparatus, and a method of manufacturing the liquid jet head.

A liquid jet head according to an embodiment of the present invention includes an actuator substrate having elongated ejection grooves and elongated non-ejection grooves partitioned by elongated walls each including a piezoelectric body. The ejection grooves and the non-ejection grooves are alternately arrayed. The non-ejection grooves have, at ends on one side thereof, respective inclined surfaces rising from bottom surfaces thereof to upper surface openings at upper portions thereof, common electrodes are provided in a strip form along a longitudinal direction of the walls on both side surfaces of the walls facing the ejection grooves, active electrodes are provided in a strip form along the longitudinal direction of the walls on both side surfaces of the walls facing the non-ejection grooves, and the active electrodes are provided from positions in the vicinity of the ends on one side of the non-ejection grooves to ends on the other side thereof.

The liquid jet head further includes a cover plate provided on the actuator substrate and having first slits communicating with one side of the ejection grooves and second slits communicating with the other side thereof; and a nozzle plate provided beneath the actuator substrate and having nozzles communicating with the ejection grooves.

The common electrodes are provided from positions of the ejection grooves to which the first slits open to ends on the other side of the ejection grooves.

Ends on one side of the active electrodes are provided closer to the other side than points of the inclined surfaces equal in depth to lower ends of the active electrodes.

The non-ejection grooves have the other side thereof extending to a peripheral end of the actuator substrate and have raised bottom portions with the actuator substrate remaining at bottoms thereof near the peripheral end.

The ejection grooves and the non-ejection grooves have respective lower surface openings on a side opposite to the upper surface openings, and the nozzle plate is provided to cover the lower surface openings.

The nozzle plate is lower in stiffness than the cover plate.

A liquid jet apparatus according to an embodiment of the present invention includes the liquid jet head having any of the above configurations; a moving mechanism configured to move the liquid jet head and a recording medium relative to each other; a liquid supply tube configured to supply liquid to the liquid jet head; and a liquid tank configured to supply the liquid to the liquid supply tube.

A method of manufacturing a liquid jet head according to the present invention includes a groove formation step of forming a plurality of grooves parallel to each other in a piezoelectric substrate; a mask provision step of providing a mask to cover ends on one side of the grooves; a conductive body accumulation step of accumulating a conductive body on the piezoelectric substrate according to an oblique deposition method; an electrode formation step of patterning the conductive body to form electrodes; a cover plate provision step of providing a cover plate on the piezoelectric substrate; and a nozzle plate provision step of providing a nozzle plate beneath the piezoelectric substrate.

The method of manufacturing a liquid ejection head further includes, before the groove formation step, a resin film formation step of forming a resin film on the piezoelectric substrate; and a pattern formation step of patterning the resin film.

The method of manufacturing a liquid jet head further includes, after the groove formation step, a piezoelectric substrate grinding step of grinding the piezoelectric substrate on a side opposite to a side where the grooves are formed to cause the grooves to penetrate the piezoelectric substrate from an upper surface to a lower surface thereof.

The nozzle plate provision step is a step of providing the nozzle plate on the lower surface of the piezoelectric substrate.

A liquid jet head according to an embodiment of the present invention includes an actuator substrate having elongated ejection grooves and elongated non-ejection grooves partitioned by elongated walls each including a piezoelectric body. The ejection grooves and the non-ejection grooves are alternately arrayed. The non-ejection grooves have, at ends on one side thereof, respective inclined surfaces rising from bottom surfaces of the non-ejection grooves to upper surface openings at upper portions thereof, common electrodes are provided in a strip form along a longitudinal direction of the walls on both side surfaces of the walls facing the ejection grooves, active electrodes are provided in a strip form along the longitudinal direction of the walls on both side surfaces of the walls facing the non-ejection grooves, and the active electrodes are provided from positions in the vicinity of the ends on one side of the non-ejection grooves to ends on the other side thereof. Thus, it is possible to provide the liquid jet head that may be manufactured with simple steps and in a short period of time.

DETAILED DESCRIPTION (First Embodiment)

Figure 1:
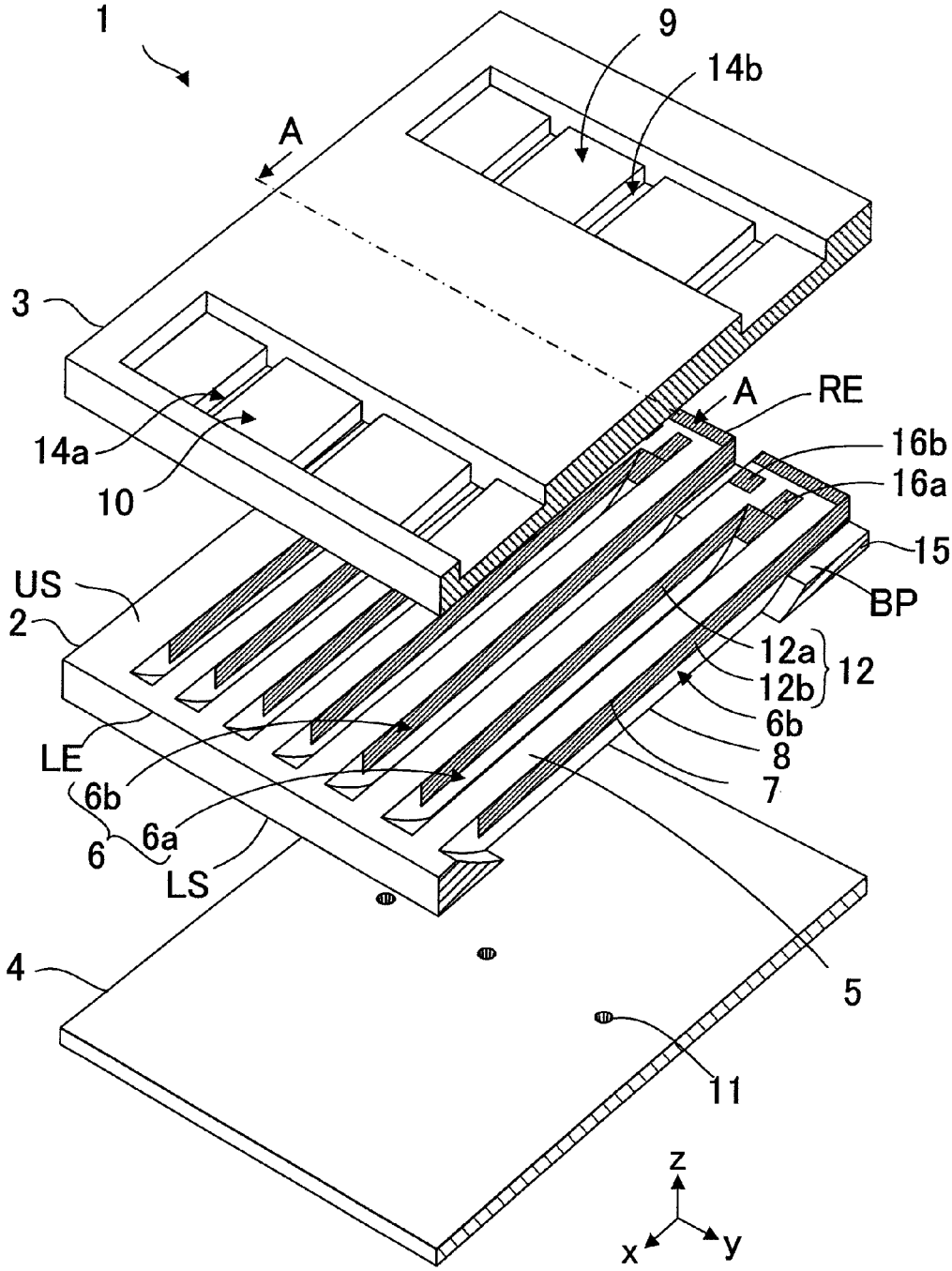
FIG. 1 is an exploded perspective view of a liquid jet head according to a first embodiment of the present invention.
Figure 2A:
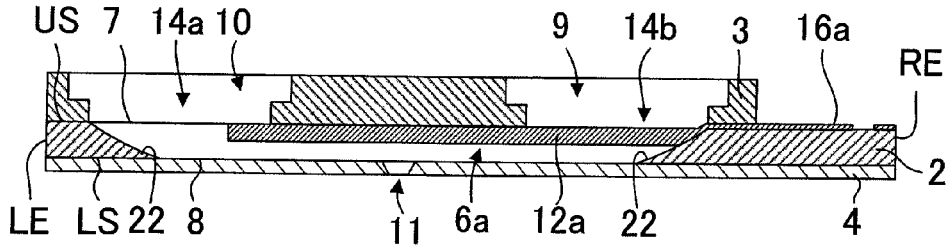
FIGS. 2A to 2C are schematic cross-sectional views of the liquid jet head according to the first embodiment of the present invention.
Figure 2B:
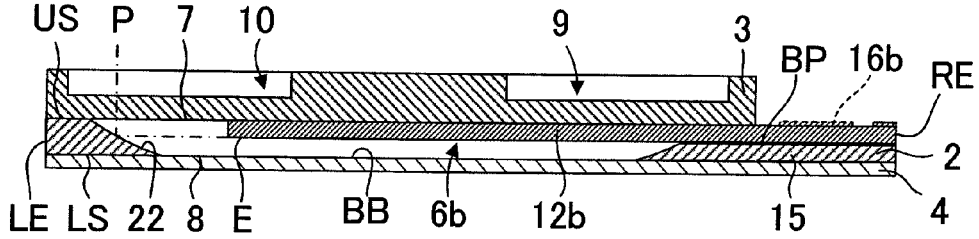
Figure 2C:
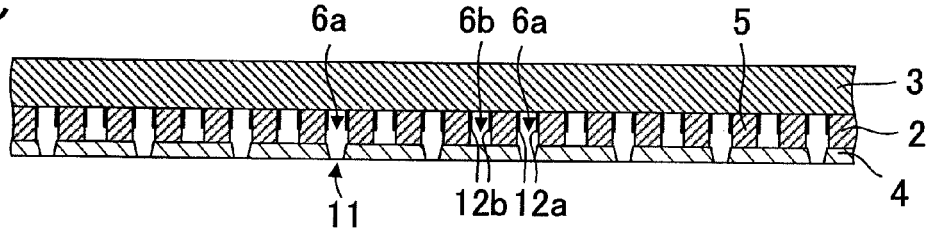

FIGS. 1 to 2C are views for explaining a liquid jet head 1 according to a first embodiment of the present invention. FIG. 1 is an exploded perspective view of the liquid jet head 1. FIG. 2A is a schematic cross-sectional view of an ejection groove 6*a* along the longitudinal direction thereof. FIG. 2B is a schematic cross-sectional view of a non-ejection groove 6*b* along the longitudinal direction thereof. FIG. 2C is a schematic partial cross-sectional view along the line A-A in FIG. 1.

As shown in FIGS. 1 to 2C, the liquid jet head 1 includes an actuator substrate 2, a cover plate 3 provided on the actuator substrate 2, and a nozzle plate 4 provided beneath the actuator substrate 2. The actuator substrate 2 has the elongated ejection grooves 6*a* and the elongated non-ejection grooves 6*b* partitioned by elongated walls 5 each made of a piezoelectric body. The elongated ejection grooves 6*a* and the elongated non-ejection grooves 6*b* are alternately arrayed. The cover plate 3 is provided on an upper surface US of the actuator substrate 2 to cover upper surface openings 7 of the ejection grooves 6*a* and the non-ejection grooves 6*b*. The cover plate 3 has first slits 14*a* communicating with one side of the ejection grooves 6*a* and second slits 14*b* communicating with the other side thereof. The nozzle plate 4 has nozzles 11 communicating with the ejection grooves 6*a* and is mounted on a lower surface LS of the actuator substrate 2. In addition, common electrodes 12*a* are provided in a strip form along the longitudinal direction of the walls 5 on both side surfaces, facing the ejection grooves 6*a*, of the walls 5 of the actuator substrate 2, while active electrodes 12*b* are provided in a strip form along the longitudinal direction of the walls 5 on both side surfaces, facing the non-ejection grooves 6*b*, of the walls 5. The active electrodes 12*b* are provided from positions in the vicinity of ends on one side of the non-ejection grooves 6*b* to ends on the other side thereof.

Here, a description will be given in further detail of the liquid jet head 1. Grooves 6 formed in the actuator substrate 2 include the ejection grooves 6*a* and the non-ejection grooves 6*b*. The ejection grooves 6*a* and the non-ejection grooves 6*b* are alternately arrayed in parallel in a direction (y direction) orthogonal to the longitudinal direction (x direction) of the grooves 6. The ejection grooves 6*a* have, at both side (one side and the other side) ends thereof in the longitudinal direction, inclined surfaces 22 rising from lower surface openings 8 to the upper surface openings 7 of the actuator substrate 2, i.e., from the lower surface LS to the upper surface US. The ejection grooves 6*a* are formed from positions in the vicinity of a peripheral end LE on one side of the actuator substrate 2 to positions in the vicinity of a peripheral end RE on the other side thereof, i.e., to the positions in the vicinity of the end of the cover plate 3. The non-ejection grooves 6*b* have, at ends on one side thereof, inclined surfaces 22 rising from bottom surfaces BB of the non-ejection grooves 6*b*, i.e., the lower surface openings 8 to the upper surface openings 7. In addition, the ends on the other side of the non-ejection grooves 6*b* extend to the peripheral end RE on the other side of the actuator substrate 2 and have raised bottom portions 15 causing the actuator substrate 2 to remain near the peripheral end RE. The raised bottom portions 15 are inclined to rise from the lower surface LS to upper surfaces BP of the raised bottom portions 15 in the same way as the ends on the other side of the ejection grooves 6*a*. The raised bottom portions 15 may contribute to an improvement in the strength of the end on the other side of the actuator substrate 2.

Drive electrodes 12 include the common electrodes 12*a* provided on the side surfaces of the ejection grooves 6*a* and the active electrodes 12*b* provided on the side surfaces of the non-ejection grooves 6*b*. The common electrodes 12*a* are provided in a strip form along the longitudinal direction of both side surfaces of the walls 5 facing the ejection grooves 6*a* and are electrically connected to each other. The common electrodes 12*a* are provided from the positions of the ejection grooves 6*a*, to which the first slits 14*a* open, to the ends on the other side of the ejection grooves 6*a*. The active electrodes 12*b* are provided on both sides surfaces of the walls 5 facing the non-ejection grooves 6*b* and are provided in a strip form from positions in the vicinity of the ends on one side of the non-ejection grooves 6*b* to the ends on the other side thereof. As shown in FIG. 2B, the ends on one side of the active electrodes 12*b* are positioned closer to the other side than points P at which the inclined surfaces 22 become equal in depth to lower ends E of the active electrodes 12*b*.

The common electrodes 12*a* and the active electrodes 12*b* are provided at a depth separating from the nozzle plate 4 constituting the bottom surfaces BB of the ejection grooves 6*a* and the non-ejection grooves 6*b*. Specifically, the common electrodes 12*a* and the active electrodes 12*b* are provided at such a depth that the lower ends E thereof are not on the same level as the upper surfaces BP of the raised bottom portions 15. On the upper surface US near the peripheral end RE on the other side of the actuator substrate 2, common terminals 16*a* electrically connected to the common electrodes 12*a* and active terminals 16*b* electrically connected to the active electrodes 12*b* are provided.

Thus, since the ejection grooves 6*a* are formed from the positions to which the first slits 14*a* open, pressure waves may be efficiently generated in liquid inside the ejection grooves 6*a*. In addition, the active electrodes 12*b* formed on both side surfaces of the non-ejection grooves 6*b* are provided from the positions in the vicinity of the ends on one side of the non-ejection grooves 6*b* to the ends on the other side thereof. More specifically, in the longitudinal direction of the non-ejection grooves 6*b*, the ends on one side of the active electrodes 12*b* are provided closer to the other side than the points P of the inclined surfaces 22 equal in depth to the lower ends E of the active electrodes 12*b*. Moreover, the upper surfaces BP of the raised bottom portions 15 are positioned below the lower ends E of the active electrodes 12*b*, and no electrode material is accumulated on the upper surfaces BP. Specifically, at the ends on one side, the respective two active electrodes 12*b* facing each other inside the non-ejection grooves 6*b* are prevented from being electrically conductive via the inclined surfaces 22. Similarly, at the ends on the other side, the respective two active electrodes 12*b* facing each other inside the non-ejection grooves 6*b* are prevented from being electrically conductive via the upper surfaces BP. Thus, the active electrodes 12*b* formed on both side surfaces of the non-ejection grooves 6*b* are electrically separated from each other. Since the above electrode structure may be formed in a single process according to an oblique deposition method that will be described later, manufacturing process steps therefor become very simple.

The cover plate 3 has a liquid discharge chamber 10 on one side of the actuator substrate 2 and a liquid supply chamber 9 on the other side thereof. The cover plate 3 is adhered to the upper surface US of the actuator substrate 2 with an adhesive such that the ejection grooves 6*a* are partially covered and the common terminals 16*a* and the active terminals 16*b* are exposed. The liquid supply chamber 9 communicates with the ends on the other side of the ejection grooves 6*a* via the second slits 14*b* and does not communicate with the non-ejection grooves 6*b*. The liquid discharge chamber 10 communicates with the ends on one side of the ejection grooves 6*a* via the first slits 14*a* and does not communicate with the non-ejection grooves 6*b*. That is, the upper surface openings 7 of the non-ejection grooves 6*b* are covered with the cover plate 3. The nozzle plate 4 is adhered to the lower surface LS of the actuator substrate 2 with an adhesive. The nozzles 11 are formed at substantially central positions in the longitudinal direction of the ejection grooves 6*a*. Liquid supplied to the liquid supply chamber 9 flows into the ejection grooves 6*a* via the second slits 14*b* and is discharged to the liquid discharge chamber 10 via the first slits 14*a*. Conversely, since the non-ejection grooves 6*b* do not communicate with the liquid supply chamber 9 or the liquid discharge chamber 10, the liquid does not flow into the non-ejection grooves 6*b*. Here, the nozzle plate 4 is lower in stiffness than the cover plate 3.

The actuator substrate 2 may be made of a piezoelectric material, e.g., PZT ceramics, to which polarization treatment is applied in a direction perpendicular to the upper surface US. The cover plate 3 may be made of the same PZT ceramics as the actuator substrate 2, machinable ceramics, some other ceramics, or a low dielectric material such as glass. If the cover plate 3 is made of the same material as the actuator substrate 2, the cover plate 3 and the actuator substrate 2 become equal in the coefficient of thermal expansion, which may prevent the occurrence of warpage and deformation upon temperature change. The nozzle plate 4 may be made of a polyimide film, a polypropylene film, some other synthetic resin film, a metal film, or the like. Here, the cover plate 3 preferably has a thickness of 0.3 mm to 1.0 mm, and the nozzle plate 4 preferably has a thickness of 0.01 mm to 0.1 mm. If the thickness of the cover plate 3 is less than 0.3 mm, the strength of the cover plate 3 reduces. On the other hand, if the thickness of the cover plate 3 is greater than 1.0 mm, time for processing the liquid supply chamber 9, the liquid discharge chamber 10, the first slits 14*a*, and the second slits 14*b* becomes long and the cost for manufacturing the cover plate 3 becomes high due to an increase in material. If the thickness of the nozzle plate 4 is less than 0.01 mm, the strength of the nozzle plate 4 reduces. On the other hand, if the thickness of the nozzle plate 4 is greater than 0.1 mm, vibrations are transmitted to the adjacent nozzles 11, which increases the likelihood of the occurrence of crosstalk.

Note that the PZT ceramics has a Young's modulus of 58.48 GPa and the polyimide film has a Young's modulus of 3.4 GPa. Accordingly, if the cover plate 3 is made of the PZT ceramics and the nozzle plate 4 is made of the polyimide film, the cover plate 3 covering the upper surface US of the actuator substrate 2 becomes higher in stiffness than the nozzle plate 4 covering the lower surface LS. The Young's modulus of the material of the cover plate 3 is preferably not less than 40 GPa, and that of the material of the nozzle plate 4 preferably falls within the range of 1.5 GPa to 30 GPa. If the Young's modulus of the material of the nozzle plate 4 is less than 1.5 GPa, the nozzle plate 4 is easily scratched when coming in contact with a recording medium, which reduces reliability. On the other hand, if the Young's modulus of the material of the nozzle plate 4 is greater than 30 GPa, vibrations are transmitted to the adjacent nozzles 11, which increases the likelihood of the occurrence of crosstalk.

The liquid jet head 1 operates as follows. Liquid is supplied to the liquid supply chamber 9 and discharged from the liquid discharge chamber 10 to be circulated. Then, a drive signal is transmitted to the common terminals 16*a* and the active terminals 16*b* to cause thickness-shear deformation in both of the walls 5 constituting the ejection grooves 6*a*. At this time, both of the walls 5 are deformed in a "truncated chevron shape" or in a "dogleg shape". Thus, pressure waves are generated in the liquid inside the ejection grooves 6*a*, whereby liquid droplets are ejected from the nozzles 11 communicating with the ejection grooves 6*a*. According to the first embodiment, since the active electrodes 12*b* provided on the side surfaces of both of the walls 5 of the non-ejection grooves 6*b* are electrically separated from each other, the respective ejection grooves 6*a* may be independently driven. The advantage of the independent drive of the respective ejection grooves 6*a* is to allow high frequency drive. Note that the liquid discharge chamber 10 and the liquid supply chamber 9 may operate in a reverse way. That is, liquid may be supplied from the liquid discharge chamber 10 and discharged from the liquid supply chamber 9. In addition, it is also possible to form protection films on inner walls with which liquid comes in contact.

Note that the whole actuator substrate 2 is not necessarily made of a piezoelectric body. That is, the walls 5 may be made of piezoelectric bodies, and portions other than the walls 5 may be made of insulation bodies composed of non-piezoelectric bodies. In addition, the first embodiment describes the case in which the raised bottom portions 15 are formed at the ends on the other side of the non-ejection grooves 6*b* and the active electrodes 12*b* are provided on the side surfaces above the upper surface BP of the raised bottom portions 15 and extended to the peripheral end RE on the other side of the actuator substrate 2. However, the present invention is not limited to this configuration. Wiring electrodes may be formed on the upper surface US along the non-ejection grooves 6*b*, and the active electrodes 12*b* and the active terminals 16*b* may be electrically connected to each other via the wiring electrodes. Moreover, the liquid discharge chamber 10 and the liquid supply chamber 9 may operate in a reverse way.

(Second Embodiment)

Figure 3:
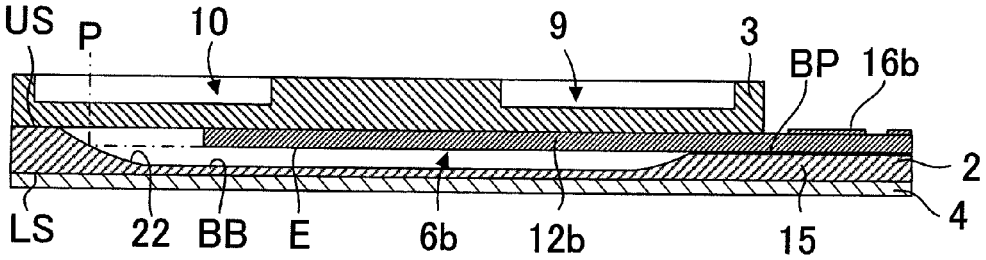
FIG. 3 is a schematic cross-sectional view of a non-ejection groove, in the longitudinal direction thereof, of a liquid jet head according to a second embodiment of the present invention.

FIG. 3 is a schematic cross-sectional view of a non-ejection groove 6*b*, in the longitudinal direction thereof, of a liquid jet head 1 according to a second embodiment of the present invention. The second embodiment is different from the first embodiment in that the non-ejection grooves 6*b* have the actuator substrate 2 at the bottoms thereof. In respect of the other configurations, the second embodiment is the same as the first embodiment. Accordingly, in the second embodiment, the non-ejection grooves 6*b* different from those of the first embodiment will be mainly described below, and the description of the ejection grooves 6*a*, which are the same as those of the first embodiment, will be omitted. In addition, the same portions or portions having the same functions as those of the first embodiment will be denoted by the same symbols.

As shown in FIG. 3, the non-ejection grooves 6*b* are formed shallower than the ejection grooves 6*a* to have the actuator substrate 2 at the bottoms of the non-ejection grooves 6*b*. Further, the nozzle plate 4 is provided on the lower surface LS of the actuator substrate 2. The ejection grooves 6*a* have the same cross section as that shown in FIG. 2A. The non-ejection grooves 6*b* are formed to have the actuator substrate 2 at the bottoms thereof by a dicing blade with grinding abrasive grains filled in the periphery of a disc-like blade. Therefore, the non-ejection grooves 6*b* are easily formed to have the longer inclined surfaces 22 in the longitudinal direction at the ends on one side thereof than the inclined surfaces 22 at the ends on one side of the ejection grooves 6*a*. In addition, the non-ejection grooves 6*b* have the raised bottom portions 15 at the ends on the other side thereof.

Also in this case, the ends on one side of the active electrodes 12*b* formed on the side surfaces of the non-ejection grooves 6*b* are provided closer to the other side than the points P of the inclined surfaces 22 equal in depth to the lower ends E of the active electrodes 12*b*. In addition, the upper surfaces BP of the raised bottom portions 15 are positioned below the lower ends E of the active electrodes 12*b*, and no electrode material is accumulated on the upper surfaces BP. Thus, the active electrodes 12*b* formed on both side surfaces of the non-ejection grooves 6*b* are electrically separated from each other. Specifically, at the ends on one side, the respective two active electrodes 12*b* facing each other inside the non-ejection grooves 6*b* are prevented from being electrically conductive via the inclined surfaces 22. Similarly, at the ends on the other side, the respective two active electrodes 12*b* facing each other inside the non-ejection grooves 6*b* are prevented from being electrically conductive via the upper surfaces BP. In addition, the presence of the actuator substrate 2 at the bottoms of the non-ejection grooves 6*b* may contribute to an improvement in the strength of the actuator substrate 2.

Note that in the second embodiment, the non-ejection grooves 6*b* have the actuator substrate 2 at the bottoms thereof. However, similar to the non-ejection grooves 6*b*, the ejection grooves 6*a* may have the actuator substrate 2 at the bottoms thereof. In this case, communication ports are formed in the actuator substrate 2 at the bottoms of the ejection grooves 6*a* to communicate with the nozzles 11 of the nozzle plate 4.

(Third Embodiment)

Figure 4A:
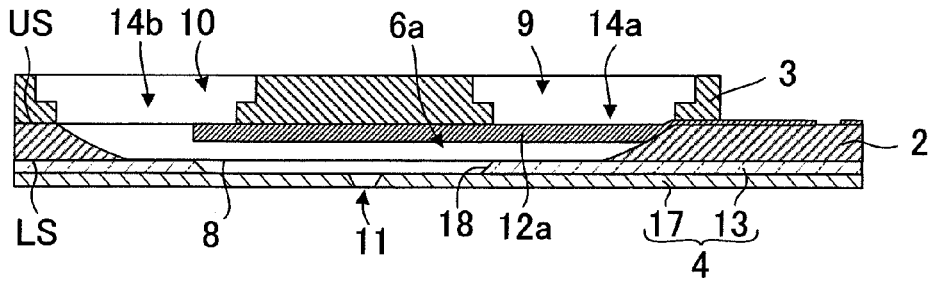
FIGS. 4A and 4B are schematic cross-sectional views of a liquid jet head according to a third embodiment of the present invention.
Figure 4B:
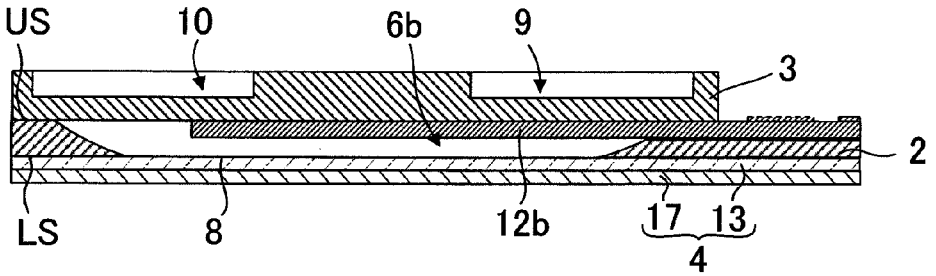

FIGS. 4A and 4B are schematic cross-sectional views of a liquid jet head 1 according to a third embodiment of the present invention. FIG. 4A is a schematic cross-sectional view of an ejection groove 6*a* in the longitudinal direction thereof. FIG. 4B is a schematic cross-sectional view of a non-ejection groove 6*b* in the longitudinal direction thereof. The third embodiment is different from the first embodiment in that the nozzle plate 4 has a multilayer structure. In respect of the other configurations, the third embodiment is the same as the first embodiment. Hereinafter, the difference between the first and third embodiments will be described, and the descriptions of the same portions will be omitted. In addition, the same portions or portions having the same functions as those of the first embodiment will be denoted by the same symbols.

As shown in FIGS. 4A and 4B, the nozzle plate 4 has a structure in which a polyimide film 17 and an auxiliary plate 13 having higher stiffness than the polyimide film 17 are laminated together. The auxiliary plate 13 is adhered to the lower surface LS of the actuator substrate 2 to cover the lower surface openings 8 of the actuator substrate 2. The auxiliary plate 13 has through holes 18 communicating with the lower surface openings 8 of the ejection grooves 6*a*. The polyimide film 17 is adhered to the auxiliary plate 13 on a side opposite to the actuator substrate 2. The polyimide film 17 has nozzles 11 communicating with the through holes 18. The opening portions of the through holes 18 of the auxiliary plate 13 are close in size to the lower surface openings 8 such that air bubbles are not accumulated at the side surfaces of the opening portions.

The auxiliary plate 13 may be made of a synthetic resin, a metal film, or the like. The auxiliary plate 13 is preferably made of a material having a Young's modulus of 1.5 GPa to 30 GPa. However, the auxiliary plate 13 may also be made of a material having a Young's modulus of greater than 30 GPa such as a metal film, as long as the nozzle plate 4 has an average Young's modulus of 1.5 GPa to 30 GPa.

(Fourth Embodiment)

Figure 5:
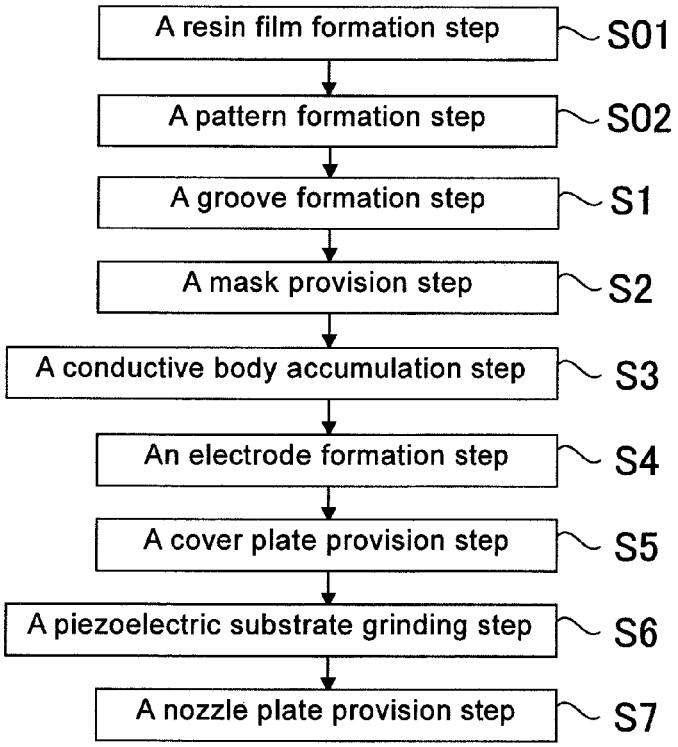
FIG. 5 is a flowchart for explaining the manufacturing process steps of a liquid jet head according to a fourth embodiment of the present invention.

FIGS. 5 to 13B are views for explaining a method of manufacturing a liquid jet head 1 according to a fourth embodiment of the present invention. FIG. 5 is a flowchart for explaining the manufacturing process steps of the liquid jet head 1 according to the fourth embodiment of the present invention. FIGS. 6A to 13B are views for explaining the respective manufacturing process steps. Hereinafter, with reference to FIGS. 5 to 13B, a description will be given in detail of the method of manufacturing the liquid jet head 1. The same portions or portions having the same functions will be denoted by the same symbols.

Figure 6A:
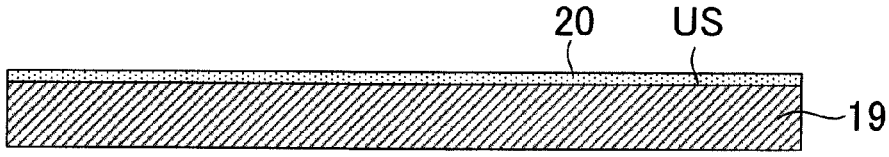
FIGS. 6A and 6B are views for explaining the process steps for manufacturing the liquid jet head according to the fourth embodiment of the present invention.
Figure 6B:
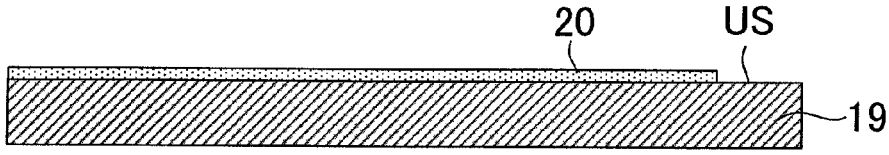

FIGS. 6A and 6B are schematic cross-sectional views of a piezoelectric substrate 19. As shown in FIG. 6A, a photosensitive resin film 20 is provided on the upper surface US of the piezoelectric substrate 19 in a resin film formation step S01. The piezoelectric substrate 19 may be made of PZT ceramics. As the resin film 20, a resist film may be coated. Alternatively, a photosensitive resin film may be provided. Then, as shown in FIG. 6B, the resin film 20 is patterned by exposure and development in a pattern formation step S02. The resin film 20 in regions in which electrodes are to be formed is removed, while the resin film 20 in regions in which the electrodes are not to be formed is caused to remain. This is because the electrodes are to be patterned according to a lift-off method later.

Figure 7A:
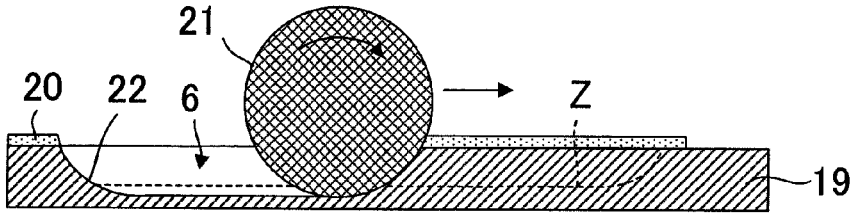
FIGS. 7A to 7D are views for explaining the process steps for manufacturing the liquid jet head according to the fourth embodiment of the present invention.
Figure 7B:
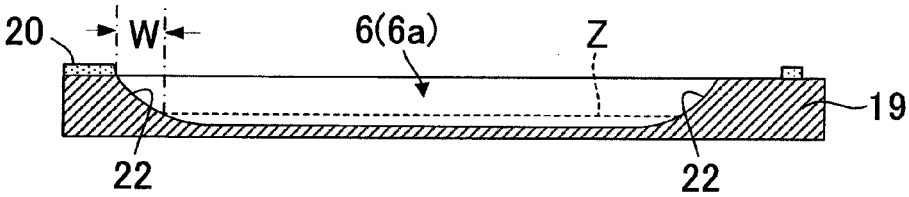
Figure 7C:
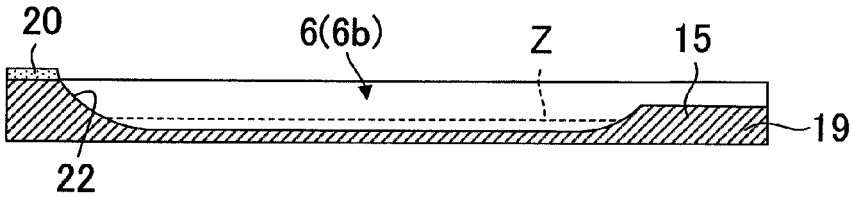
Figure 7D:
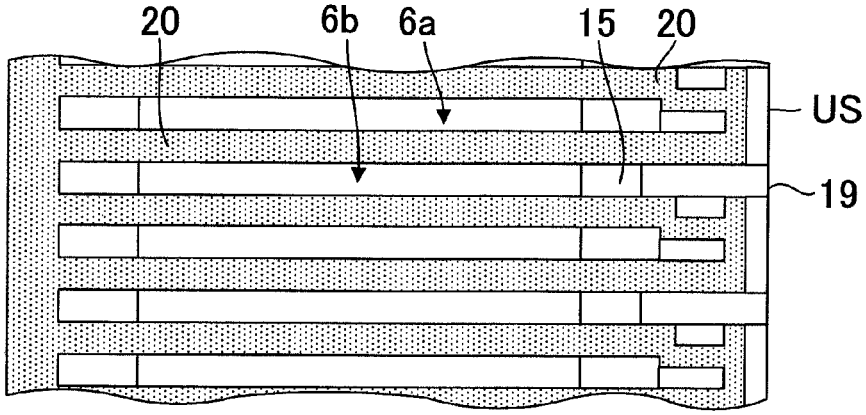

FIG. 7A is a schematic cross-sectional view of a groove 6 being formed by being ground by a dicing blade 21. FIG. 7B is a schematic cross-sectional view of the ejection groove 6*a*. FIG. 7C is a schematic cross-sectional view of the non-ejection groove 6*b*. FIG. 7D is a schematic top view of the piezoelectric substrate 19 in which the grooves 6 are formed. As shown in FIGS. 7A to 7D, the plurality of grooves 6 is formed in parallel in the piezoelectric substrate 19 in a groove formation step S1. The grooves 6 include the ejection grooves 6*a* and the non-ejection grooves 6*b*. The ejection grooves 6*a* and the non-ejection grooves 6*b* are alternately formed in parallel. The dicing blade 21 is moved downward to the ends on one side of the grooves 6, moved horizontally, and then moved upward at the ends on the other side. The dicing blade 21 grinds the piezoelectric substrate 19 so as not to reach the lower surface of the actuator substrate 2 and grinds the same at a level deeper than a dashed line Z indicating the depth of the ejection grooves 6*a* and the non-ejection grooves 6*b*. In addition, the dicing blade 21 shallowly grinds the non-ejection grooves 6*b* at the ends on the other side toward the peripheral end of the piezoelectric substrate 19 to form the raised bottom portions 15.

By grinding the piezoelectric substrate 19 at the level deeper than the dashed line Z indicating the ultimate depth of the ejection grooves 6*a* and the non-ejection grooves 6*b*, the width W in the longitudinal direction of the inclined surfaces 22 may be reduced. That is, since the piezoelectric substrate 19 is ground by the dicing blade 21, the peripheral shape of the dicing blade 21 is transferred to the ends on one side of the ejection grooves 6*a*, the ends on the other side of the ejection grooves 6*a*, and the ends on one side of the non-ejection grooves 6*b*. For example, if grooves having a depth of 360 μm are formed by a 2-inch dicing blade 21, the inclined surfaces 22 at the ends have a width of about 4 mm in the longitudinal direction. On the other hand, if grooves having a depth of 590 μm are formed by the same dicing blade 21, the width W in the longitudinal direction of the inclined surfaces 22 to the depth of 360 μm may be reduced by half, i.e., reduced to about 2 mm. The widths of the inclined surfaces 22 at the ends on one side and the ends on the other side are reduced by 4 mm in total, whereby the number of the piezoelectric substrates 19 taken from a piezoelectric body wafer may be increased.

Figure 8A:
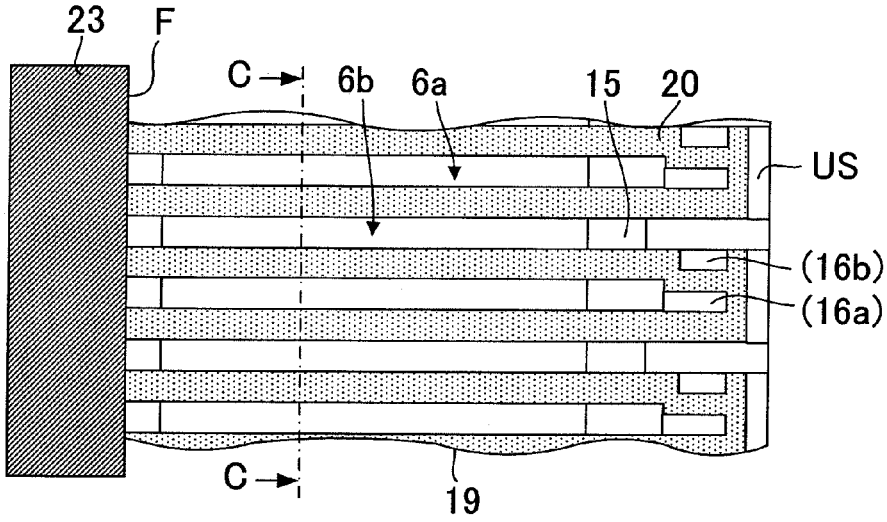
FIGS. 8A and 8B are views for explaining the process steps for manufacturing the liquid jet head according to the fourth embodiment of the present invention.
Figure 8B:
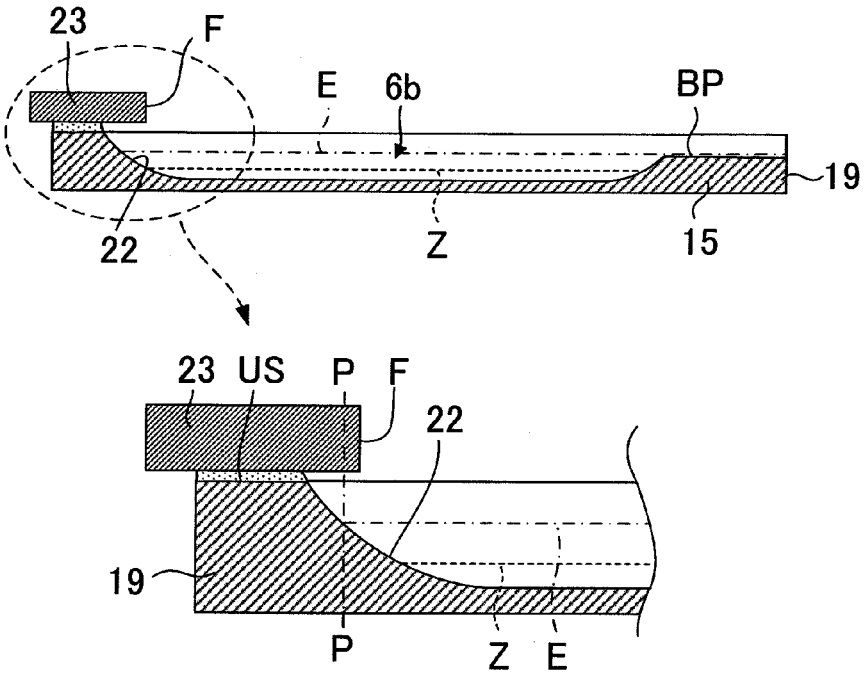

FIGS. 8A and 8B are views for explaining a state in which a mask 23 is provided at the end on one side of the piezoelectric substrate 19. FIG. 8A is a schematic top view of the piezoelectric substrate 19. FIG. 8B is a schematic cross-sectional view along the longitudinal direction of the non-ejection groove 6*b*. As shown in FIGS. 8A and 8B, the mask 23 is provided on the piezoelectric substrate 19 to cover the ends on one side of the grooves 6 in a mask provision step S2. The mask 23 has an end F on the other side thereof at a position closer to the other side than the points P of the inclined surfaces 22 equal in depth to the lower ends E of the active electrodes 12*b*. The mask 23 is provided at a position to which the first slits 14*a* communicating with the ejection grooves 6*a* open to the side of the ejection grooves 6*a*. In other words, the inclined surfaces 22 shallower than the lower ends E of the active electrodes 12*b* and the upper surface US on one side are covered with the mask 23, and the ends on one side of the common electrodes 12*a* are positioned at the opening regions of the first slits 14*a* on the side of the ejection grooves 6*a*.

Figure 9:
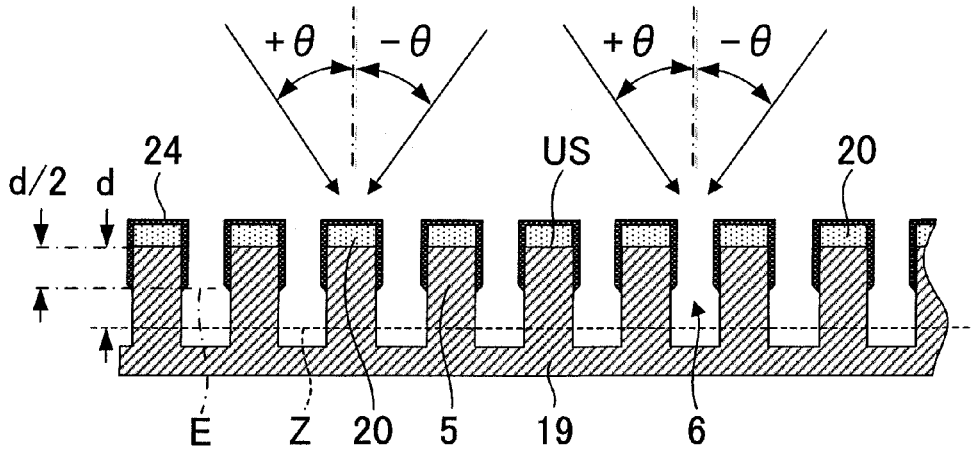
FIG. 9 is a view for explaining the process steps for manufacturing the liquid jet head according to the fourth embodiment of the present invention.

FIG. 9 is a schematic cross-sectional view taken along the line C-C in FIG. 8A, showing a conductive body 24 accumulated according to an oblique deposition method. In a conductive body accumulation step S3, the conductive body 24 is deposited on the upper surface US of the piezoelectric substrate 19 according to the deposition method at angles +θand −θ inclined in a direction orthogonal to the longitudinal direction of the grooves 6 relative to the normal line of the upper surface US. In the fourth embodiment, the conductive body 24 is accumulated to approximately half d/2 of a depth d from the upper surface US of the walls 5 to a dashed line Z. Since the inclined surfaces 22 formed at the ends on one side of the non-ejection grooves 6*b* are covered with the mask 23 at least in regions thereof shallower than the depth d/2, the conductive body 24 is not accumulated in these regions. In addition, since the upper surfaces BP of the raised bottom portions 15 are positioned below the lower ends E, the conductive body 24 is not accumulated on the upper surfaces BP. Conversely, the conductive body 24 is accumulated on the inclined surfaces formed at the ends on the other side of the ejection grooves 6*a* in regions shallower than the depth d/2 in the same way as the upper surface US. Note that the conductive body 24 may be formed shallower than the dashed line Z indicating the ultimate depth of the grooves 6 and deeper than the depth d/2.

Figure 10:
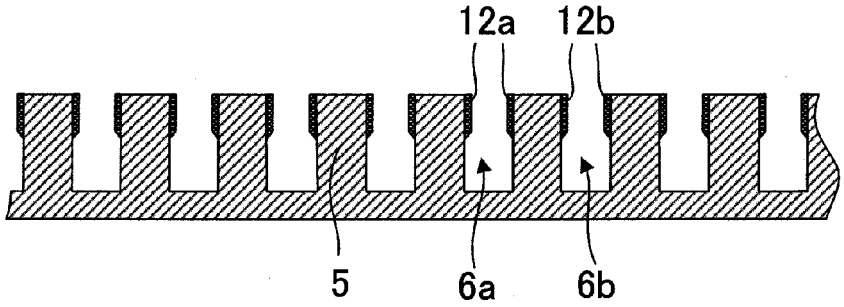
FIG. 10 is a view for explaining the process steps for manufacturing the liquid jet head according to the fourth embodiment of the present invention.

FIG. 10 is a view showing a state in which the resin film 20 and the conductive body 24 on the resin film 20 are removed at the same time. In an electrode formation step S4, the conductive body 24 is patterned to form the common electrodes 12*a* and the active electrodes 12*b*. That is, the conductive body 24 accumulated on the upper surface of the resin film 20 is removed according to a lift-off method for removing the resin film 20. Thus, the conductive body 24 accumulated on both side surfaces of the walls 5 are separated to form the common electrodes 12*a* and the active electrodes 12*b*. Note that in the electrode formation step S4, the common terminals 16*a* and the active terminals 16*b* are formed at the same time (see FIG. 8A). Thus, the active electrodes 12*b* formed on both side surfaces of the non-ejection grooves 6*b* are electrically separated from each other, and the common electrodes 12*a* formed on both side surfaces of the ejection grooves 6*a* are electrically connected to each other. Note that the lower ends E of the common electrodes 12*a* and the active electrodes 12*b* formed according to the oblique deposition method are positioned at approximately ½ of the ultimate depth d of the ejection grooves 6*a* and the non-ejection grooves 6*b* but may be positioned at a deeper level. Also in this case, the lower ends E of the common electrodes 12*a* and the active electrodes 12*b* are positioned so as not to reach the dashed line Z indicating the ultimate depth of the ejection grooves 6*a* and the non-ejection grooves 6*b*. With the common electrodes 12*a* and the active electrodes 12*b* separated from the dashed line Z indicating the bottom surfaces of the ejection grooves 6*a* and the non-ejection grooves 6*b*, liquid droplets may be stably ejected.

Figure 11A:
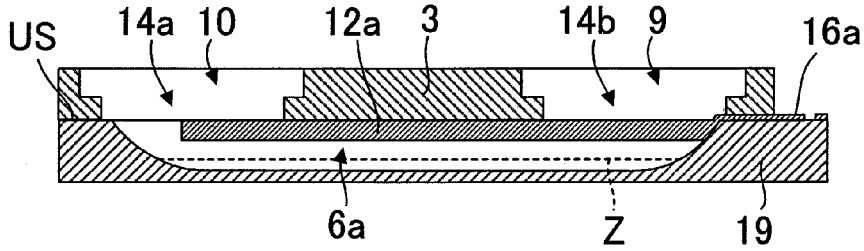
FIGS. 11A and 11B are views for explaining the process steps for manufacturing the liquid jet head according to the fourth embodiment of the present invention.
Figure 11B:
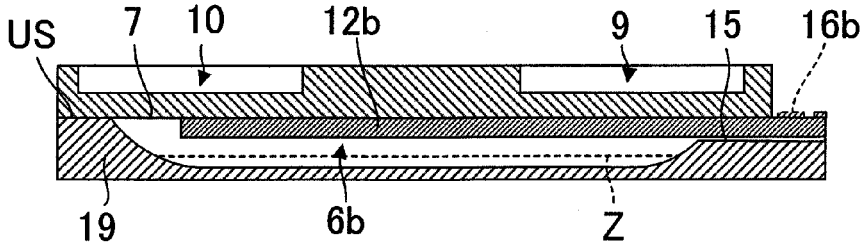

FIGS. 11A and 11B are schematic cross-sectional views of the cover plate 3 provided on the piezoelectric substrate 19. FIG. 11A is a schematic cross-sectional view of the ejection groove 6*a* in the longitudinal direction thereof. FIG. 11B is a schematic cross-sectional view of the non-ejection groove 6*b* in the longitudinal direction thereof. As shown in FIGS. 11A and 11B, the cover plate 3 is provided on the piezoelectric substrate 19 in a cover plate provision step S5. The cover plate 3 has the liquid discharge chamber 10 on one side thereof and the liquid supply chamber 9 on the other side thereof. In addition, the cover plate 3 has the first slits 14*a* penetrating the liquid discharge chamber 10 to the rear surface thereof and the second slits 14*b* penetrating the liquid supply chamber 9 to the rear surface thereof. The liquid discharge chamber 10 communicates with the ends on one side of the ejection grooves 6*a* via the first slits 14*a*, and the liquid supply chamber 9 communicates with the ends on the other side of the ejection grooves 6*a* via the second slits 14*b*. In addition, the upper surface openings 7 of the non-ejection grooves 6*b* are blocked by the cover plate 3, and thus the non-ejection grooves 6*b* do not communicate with the liquid discharge chamber 10 or the liquid supply chamber 9.

Figure 12A:
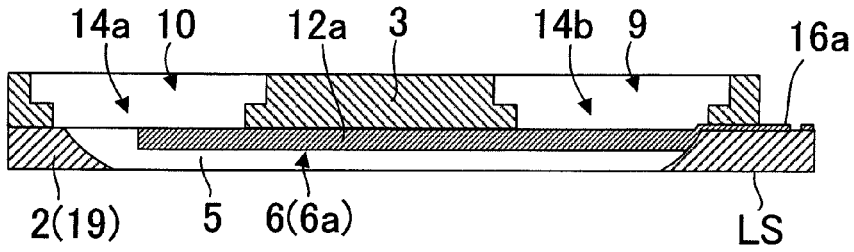
FIGS. 12A and 12B are views for explaining the process steps for manufacturing the liquid jet head according to the fourth embodiment of the present invention.
Figure 12B:
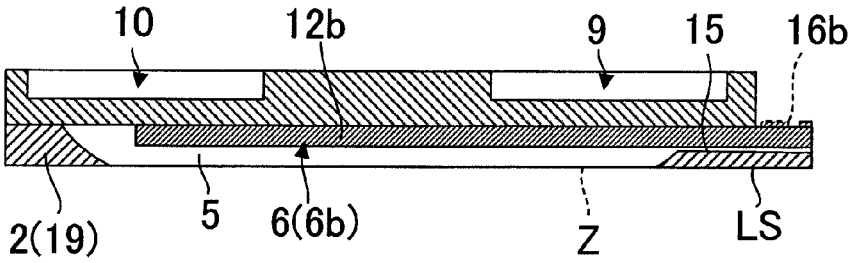

FIGS. 12A and 12B are schematic cross-sectional views showing a state in which the rear surface of the piezoelectric substrate 19 on a side opposite to the cover plate 3 is ground. FIG. 12A is a schematic cross-sectional view of the ejection groove 6*a* in the longitudinal direction thereof. FIG. 12B is a schematic cross-sectional view of the non-ejection groove 6*b* in the longitudinal direction thereof. As shown in FIGS. 12A and 12B, the piezoelectric substrate 19 on the side opposite to the side thereof where the grooves 6 are formed is ground to make the grooves 6 penetrate the piezoelectric substrate 19 from the upper surface US to the lower surface LS to form the actuator substrate 2 in a piezoelectric substrate grinding step S6. The rear surface of the piezoelectric substrate 19 is ground to the dashed line Z indicating the ultimate depth of the grooves 6. Since the upper surface US of the walls 5 is fixed by the cover plate 3 and the piezoelectric substrate 19 remains at the ends on one side of the grooves 6 and the ends on the other side thereof including the raised bottom portions 15, breakage may be prevented upon grinding of the piezoelectric substrate 19. Note that the piezoelectric substrate grinding step S6 may be omitted if the cutting depth of the dicing blade 21 is deepened in the groove formation step S1 shown in FIGS. 7A to 7D and the grooves 6 are formed to open to the lower surface of the piezoelectric substrate 19.

Figure 13A:
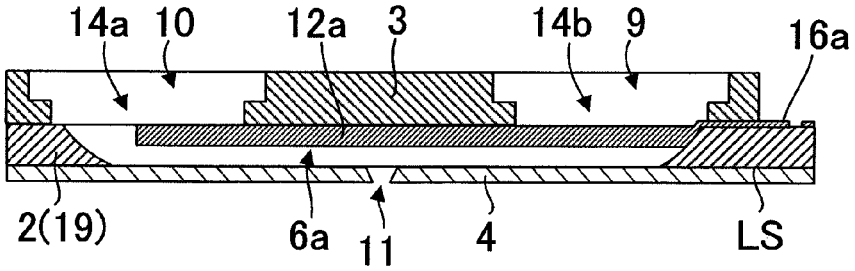
FIGS. 13A and 13B are views for explaining the process steps for manufacturing the liquid jet head according to the fourth embodiment of the present invention.
Figure 13B:
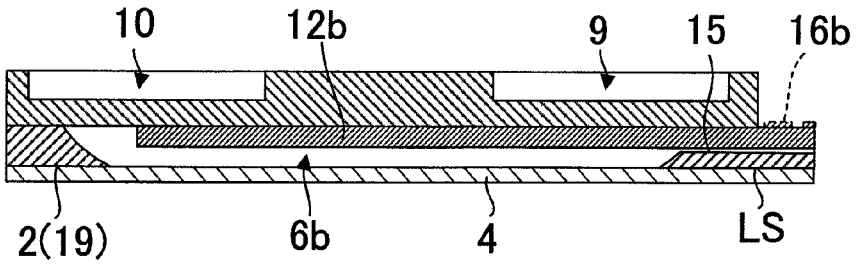

FIGS. 13A and 13B are views showing the nozzle plate 4 adhered to the lower surface LS of the actuator substrate 2 (piezoelectric substrate 19). FIG. 13A is a schematic cross-sectional view of the ejection groove 6*a* in the longitudinal direction thereof. FIG. 13B is a schematic cross-sectional view of the non-ejection groove 6*b* in the longitudinal direction thereof. As shown in FIGS. 13A and 13B, the nozzle plate 4 is provided on the lower surface LS of the piezoelectric substrate 19. The nozzle plate 4 has the nozzles 11 opening therein, and the nozzles 11 communicate with the ejection grooves 6*a*. The nozzle plate 4 is lower in stiffness than the cover plate 3.

According to the above manufacturing method, the active electrodes 12*b* formed on both side surfaces of the non-ejection grooves 6*b* may be electrically separated from each other in a lump. Therefore, it is not necessary to separate the conductive body formed on the upper surface of the walls 5 into pieces, which makes the manufacturing method very simple. In addition, the width of the inclined surfaces 22 formed at the ends of the respective grooves 6 may be reduced. Therefore, with an increase in the number of the piezoelectric substrates 19 taken from a piezoelectric body wafer, the manufacturing cost may be reduced.

Note that in the piezoelectric substrate 19, at least the walls 5 partitioning the respective grooves 6 may be made of piezoelectric bodies, and portions other than the walls 5 may be made of insulation bodies composed of non-piezoelectric bodies. In addition, as described in the second embodiment, the non-ejection grooves 6*b* (or the ejection grooves 6*a*) may have the material of the actuator substrate 2 remaining at the bottoms thereof. Moreover, the nozzle plate 4 is not necessarily composed of a single layer but may be composed of a plurality of thin film layers different in material. Further, in the fourth embodiment, the common electrodes 12*a*, the active electrodes 12*b*, the common terminals 16*a*, and the active terminals 16*b* are patterned according to the lift-off method. However, the present invention is not limited to this. For example, after forming the conductive body 24 on the upper surface US and the side surfaces of the piezoelectric substrate 19 according to the oblique deposition method in the conductive body accumulation step S3 (FIG. 9), the common electrodes 12*a*, the active electrodes 12*b*, the common terminals 16*a*, and the active terminals 16*b* may be patterned according to photolithography and an etching method.

(Fifth Embodiment)

Figure 14:
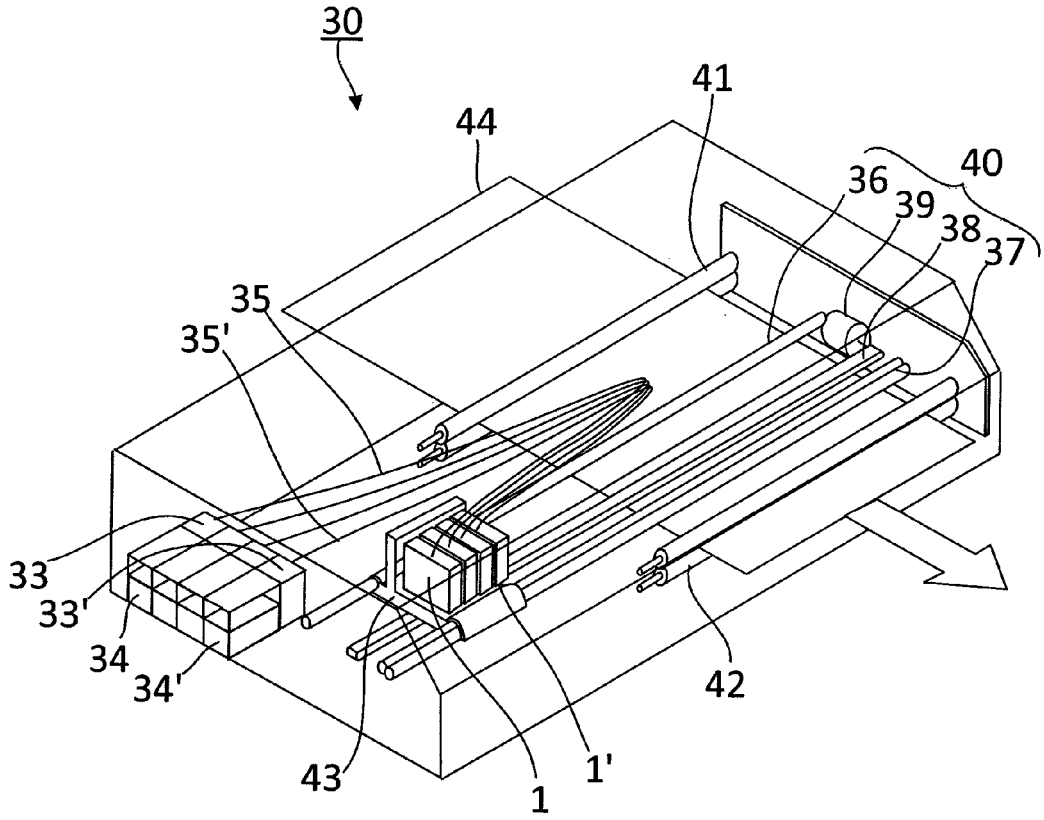
FIG. 14 is a schematic perspective view of a liquid jet apparatus according to a fifth embodiment of the present invention.
Figure 15:
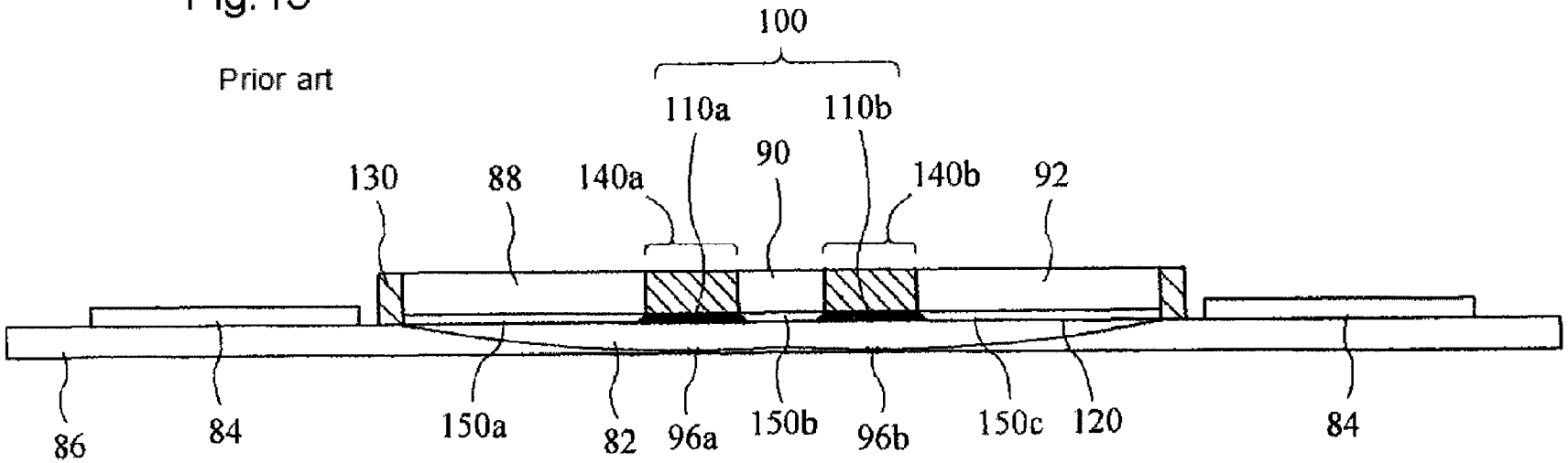
Fig.15 Prior art
FIG. 15 is a cross-sectional view of a small droplet deposition apparatus known in the related art.
Figure 16:
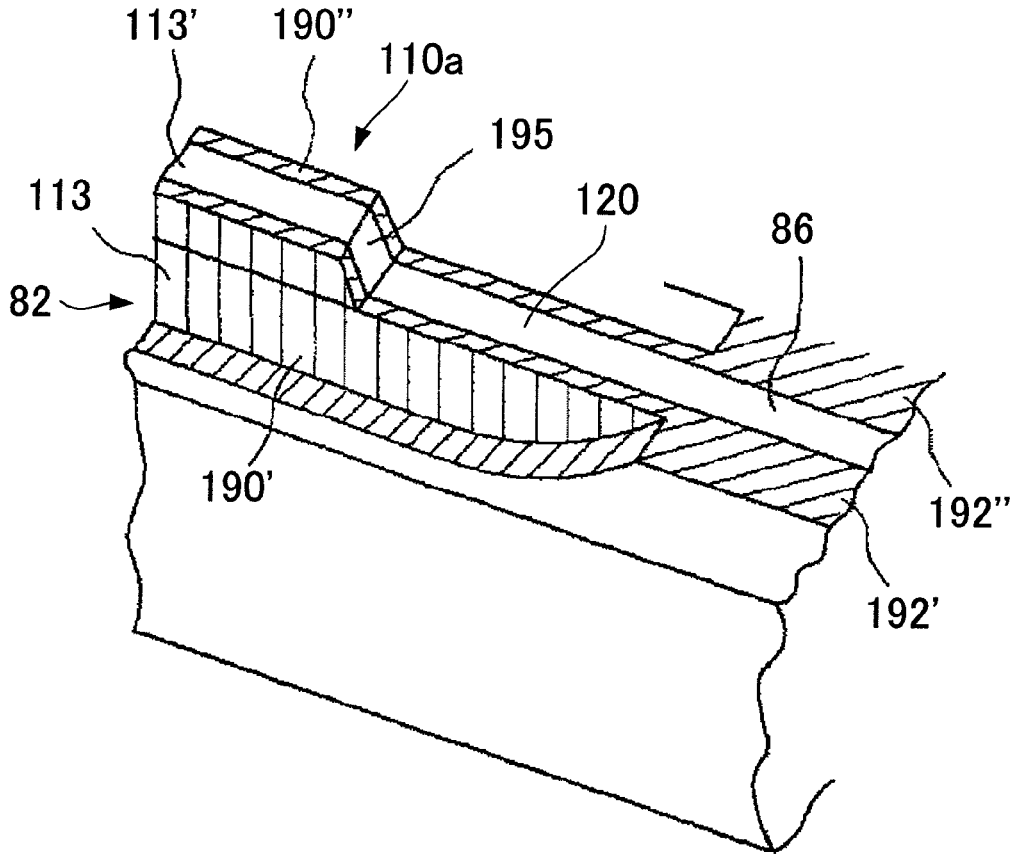
Fig.16 Prior art
FIG. 16 is a partial perspective view of the small droplet deposition apparatus known in the related art.

FIG. 14 is a schematic perspective view of a liquid jet apparatus 30 according to a fifth embodiment of the present invention. The liquid jet apparatus 30 includes a moving mechanism 40 that reciprocates liquid jet heads 1 and 1', flow path sections 35 and 35' that supply liquid to the liquid jet heads 1 and 1' and discharge the liquid from the liquid jet heads 1 and 1', and liquid pumps 33 and 33' and liquid tanks 34 and 34' that communicate with the flow path sections 35 and 35'. The respective liquid jet heads 1 and 1' have a plurality of head chips. The respective head chips have channels composed of a plurality of ejection grooves and eject liquid droplets from nozzles communicating with the respective channels. As the liquid pumps 33 and 33', any or both of supply pumps that supply the liquid to the flow path sections 35 and 35' and discharge pumps that discharge the liquid are provided. In addition, a pressure sensor and a flow rate sensor (not shown) may be provided to control the flow rate of the liquid. As the liquid jet heads 1 and 1', any of the liquid jet heads described in the first to fourth embodiments is used.

The liquid jet apparatus 30 includes a pair of conveyance units 41 and 42 that conveys a recording medium 44 such as a paper in a main scanning direction; the liquid jet heads 1 and 1' that eject the liquid onto the recording medium 44; a carriage unit 43 that has the liquid jet heads 1 and 1' mounted thereon; the liquid pumps 33 and 33' that supply the liquid stored in the liquid tanks 34 and 34' to the flow path sections 35 and 35' under pressure; and the moving mechanism 40 that causes the liquid jet heads 1 and 1' to scan in a sub-scanning direction orthogonal to the main scanning direction. A control unit (not shown) controls and drives the liquid jet heads 1 and 1', the moving mechanism 40, and the conveyance units 41 and 42.

The pair of conveyance units 41 and 42 extends in the sub-scanning direction and has grid rollers and pinch rollers that rotate with the roller surfaces thereof coming in contact with each other. The grid rollers and the pinch rollers are caused to rotate about the shafts thereof by a motor (not shown) to convey the recording medium 44 held between the rollers in the main scanning direction. The moving mechanism 40 includes a pair of guide rails 36 and 37 that extend in the sub-scanning direction; the carriage unit 43 slidable along the pair of guide rails 36 and 37; an endless belt 38 that is connected to the carriage unit 43 and moves the carriage unit 43 in the sub-scanning direction; and a motor 39 that revolves the endless belt 38 via pulleys (not shown).

The carriage unit 43 has the plurality of liquid jet heads 1 and 1' mounted thereon and ejects, for example, four types of liquid droplets of yellow, magenta, cyan, and black. The liquid tanks 34 and 34' store the liquids of corresponding colors and supply the same to the liquid jet heads 1 and 1' via the liquid pumps 33 and 33' and the flow path sections 35 and 35'. The respective liquid jet heads 1 and 1' eject liquid droplets of the respective colors in response to a drive signal. With the control of timing for ejecting the liquid from the liquid jet heads 1 and 1', the rotation of the motor 39 that drives the carriage unit 43, and the conveyance speed of the recording medium 44, any pattern may be recorded on the recording medium 44.

Note that in the liquid jet apparatus 30 according to the fifth embodiment, the moving mechanism 40 moves the carriage unit 43 and the recording medium 44 to perform recording. Alternatively, a liquid jet apparatus may be used in which a moving mechanism two-dimensionally moves a recording medium to perform recording with a carriage unit fixed. That is, the moving mechanism may have any configuration as long as it can move liquid jet heads and a recording medium relative to each other.

What is claimed is:

1. A liquid jet head, comprising:

an actuator substrate having elongated ejection grooves and elongated non-ejection grooves partitioned by elongated walls each including a piezoelectric body, the ejection grooves and the non-ejection grooves being alternately arrayed, and the non-ejection grooves having, at ends on one side thereof, respective inclined surfaces rising from bottom surfaces thereof to upper surface openings at upper portions thereof;

common electrodes provided in a strip form along a longitudinal direction of the walls on both side surfaces of the walls facing the ejection grooves; and active electrodes arc provided in a strip form along the longitudinal direction of the walls on both side surfaces of the walls facing the non-ejection grooves, the active electrodes being provided from positions in the vicinity of the ends on the one side of the non-ejection grooves to ends on the other side thereof.

2. The liquid jet head according to claim 1, further comprising;

a cover plate provided on the actuator substrate and having first slits communicating with one side of the ejection grooves and second slits communicating with the other side thereof; and a nozzle plate provided beneath the actuator substrate and having nozzles communicating with the ejection grooves.

3. The liquid jet head according to claim 2, wherein the common electrodes are provided from positions of the ejection grooves to which the first slits open to ends on the other side of the ejection grooves.

4. The liquid jet head according to claim 2, wherein the ejection grooves and the non-ejection grooves have respective lower surface openings on a side opposite to the upper surface openings, and the nozzle plate is provided to cover the lower surface openings.

5. The liquid jet head according to claim 2, wherein the nozzle plate is lower in stiffness than the cover plate.

6. The liquid jet head according to claim 1, wherein ends on one side of the active electrodes are provided closer to the other side than points of the inclined surfaces equal in depth to lower ends of the active electrodes.

7. The liquid jet head according to claim 1, wherein the non-ejection grooves have the other sides thereof extending to a peripheral end of the actuator substrate and have raised bottom portions comprised of the actuator substrate at bottoms thereof near the peripheral end.

8. A liquid jet apparatus, comprising:

the liquid jet head according to claim 1;

a moving mechanism configured to move the liquid jet head and a recording medium relative to each other;

a liquid supply tube configured to supply liquid to the liquid jet head; and a liquid tank configured to supply the liquid to the liquid supply tube.

9. The liquid jet head according to claim 1, wherein ends of the active electrodes in the vicinity of the ends on the one side of the non-ejection grooves are spaced in the longitudinal direction from the inclined surfaces of the non-ejection grooves.

10. A method of manufacturing a liquid jet head, comprising:

a groove formation step of forming a plurality of ejection grooves and non-ejection grooves parallel to each other and alternately arrayed in a piezoelectric substrate, the non-ejection grooves each having at one end portion thereof an inclined surface extending from a bottom surface of the non-ejection groove to an upper surface opening thereof;

a mask provision step of providing a mask to cover end portions of the grooves including the shallow ends of the inclined surfaces on one side of the grooves;

a conductive body accumulation step of accumulating a conductive body on the piezoelectric substrate by oblique deposition;

an electrode formation step of patterning the conductive body to form electrodes;

a cover plate provision step of providing a cover plate on the piezoelectric substrate; and a nozzle plate provision step of providing a nozzle plate beneath the piezoelectric substrate.

11. The method of manufacturing a liquid ejection head according to claim 10, further comprising, before the groove formation step:

a resin film formation step of forming a resin film on the piezoelectric substrate; and a pattern formation step of patterning the resin film.

12. The method of manufacturing a liquid jet head according to claim 9, further comprising, after the groove formation step:

a piezoelectric substrate grinding step of grinding the piezoelectric substrate on a side opposite to a side where the grooves are formed to cause the grooves to penetrate the piezoelectric substrate from an upper surface to a lower surface thereof.

13. The method of manufacturing a liquid jet head according to claim 12, wherein the nozzle plate provision step comprises providing the nozzle plate on the lower surface of the piezoelectric substrate.

14. A liquid jet head, comprising:

an actuator substrate having longitudinally extending ejection grooves and longitudinally extending non-ejection grooves alternately arrayed and separated from one another by walls made of piezoelectric material, the non-ejection grooves each having at one end portion thereof an inclined surface extending from a bottom surface of the non-ejection groove to an upper surface opening thereof;

common electrodes extending longitudinally along opposed facing walls of the ejection grooves; and active electrodes extending longitudinally along opposed facing walls of the non-ejection grooves, the active electrodes each having one end positioned in the vicinity of the one end portion of the non-ejection groove and another end positioned at the other end of the non-ejection groove.

15. The liquid jet head according to claim 14; wherein the one ends of the active electrodes are longitudinally spaced from the inclined surfaces of the non-ejection grooves.

16. The liquid jet head according to claim 14; wherein the active electrodes extend from the upper surface openings of the non-ejection grooves to approximately half the depth of the non-ejection grooves.

17. The liquid jet head according to claim 14; wherein the ejection grooves and the non-ejection grooves have respective lower surface openings on a side opposite the upper surface openings; and a nozzle plate is provided to cover the lower surface openings.

18. A liquid jet apparatus, comprising:

the liquid jet head according to claim 14;

a moving mechanism configured to move the liquid jet head and a recording medium relative to each other;

a liquid supply tube configured to supply liquid to the liquid jet head; and a liquid tank configured to supply the liquid to the liquid supply tube.

* * * * *